US005256087A

United States Patent [19]

Hendel

[11] Patent Number: 5,256,087

[45] Date of Patent: Oct. 26, 1993

[54] METHOD FOR FASTENING A FLAT PLUG IN THE BASE OF AN ELECTRICAL COMPONENT AND A BASE PRODUCED IN ACCORDANCE WITH THE METHOD

[75] Inventor: Horst Hendel, Berlin, Fed. Rep. of Germany

[73] Assignee: Siemens Aktiengesellschaft, Munich

[21] Appl. No.: 920,457

[22] PCT Filed: Dec. 3, 1990

[86] PCT No.: PCT/EP90/02076

§ 371 Date: Aug. 20, 1992

§ 102(e) Date: Aug. 20, 1992

[87] PCT Pub. No.: WO91/13453

PCT Pub. Date: Sep. 5, 1991

[30] Foreign Application Priority Data

Feb. 20, 1990 [EP] European Pat. Off. ..... 90103270.6

[51] Int. Cl.[5] ..... H01R 13/415

[52] U.S. Cl. ..... 439/741; 29/845; 403/279

[58] Field of Search ..... 439/84, 741, 870; 29/844, 845; 403/274, 276, 279

[56] References Cited

U.S. PATENT DOCUMENTS

| | | | |
|---|---|---|---|
| 2,314,855 | 3/1943 | Del Camp | 439/741 |
| 2,782,392 | 2/1957 | Stolle | 439/741 |
| 2,958,069 | 10/1960 | Redick et al. | 439/741 |
| 3,833,879 | 9/1974 | Aidn et al. | 439/741 |
| 4,047,790 | 9/1977 | Carino | 439/741 |
| 4,837,538 | 6/1989 | Dittmann | 335/202 |

FOREIGN PATENT DOCUMENTS

| | | |
|---|---|---|
| 0281950 | 9/1988 | European Pat. Off. . |
| 2218501 | 9/1973 | Fed. Rep. of Germany . |
| 2728509 | 1/1979 | Fed. Rep. of Germany . |
| 2833153 | 2/1980 | Fed. Rep. of Germany . |
| 1176688 | 4/1959 | France . |
| 2252642 | 6/1975 | France . |
| 2027996 | 2/1980 | United Kingdom . |

*Primary Examiner*—Gary F. Paumen

*Attorney, Agent, or Firm*—Hill, Steadman & Simpson

[57] ABSTRACT

Before the flat plug (4) is inserted into a perforation (3) of the base (1), at least one rib (7) extending in the direction of insertion is stamped on a flat side. After the flat plug (4) has been inserted, the rib (7) is peeled opposite the direction of insertion and deformed in the direction towards the underside of the base. This results in a positively locking fastening of the flat plug (4) without deformations in the perforation (3) of the base.

9 Claims, 3 Drawing Sheets

METHOD FOR FASTENING A FLAT PLUG IN THE BASE OF AN ELECTRICAL COMPONENT AND A BASE PRODUCED IN ACCORDANCE WITH THE METHOD

BACKGROUND OF THE INVENTION

1. Field of the Invention

The invention relates to a method for fastening a flat plug in the base, consisting of insulating material, of an electrical component, for example a relay, the flat plug being inserted through a perforation in the flat base floor until it is supported by at least one integrally formed shoulder on a first surface of the base floor and is then clamped on the opposite second surface of the base floor by means of at least one projection formed out of the flat plug. Moreover, the invention relates to a base produced accordingly, and to the use of such a base in an electromagnetic relay.

2. Description of the Related Art

Such a fastening of a flat plug is to found, for example, in EP-A-0,281,950. There, the flat plugs are provided in each case with outwardly slanting latching tabs, which yield somewhat resiliently when the flat plug is inserted through the base and then clamp in the manner of barbs on the underside of the base. Such fastening tabs directed opposite the plug-in direction can be pressed out of the connector material even after being inserted. However, such latching does not always produce a sufficiently stable interference fit, while the possibility of applying tools for subsequent pressing out is unfavorable. Deformations can also be caused in this case. This type of fastening also requires elasticity in the plastic of the base; brittle plastics are unsuitable for this purpose.

Notching of the flat plug elements after insertion is also customary for such flat plugs, notches being struck in each case on the narrow sides of the flat plugs and the notch tabs cut free being pressed outwards. Even with this method, it is not always possible to achieve a reliable interference fit, in particular given the occurrence of strong forces against the direction of insertion. Moreover, the notches cause deformations in the perforation of the base, as a result of which plastic material easily breaks away, in particular at the edges of the perforation.

It is known from FR-A-1,176,688 to provide a flat terminal post with elongated stamped ribs on the flat sides for the purpose of fastening in a recess of a printed circuit board or of a base. However, the fixing of the post is performed there, as well, by notching on the narrow sides, as a result of which, in turn, the abovementioned deformations occur at the edges of the plastic material.

Particularly when the flat plugs and thus also the perforations for the flat plugs are arranged near the edge of the base, the known processes lead to deformation or even tearing of the plastic material at the edge of the base, or it is impossible to achieve a good interference fit of a flat plug, at least because of the deflection of the plastic.

SUMMARY OF THE INVENTION

As mentioned at the beginning, it is the aim of the invention to specify a method for fastening a flat plug in the base of an electrical component, by means of which it is possible to ensure a reliable interference fit of the respective flat plug in the base, in a relatively simple fashion in terms of production engineering. The term flat plug is to be understood here generally as a connector element consisting of sheet metal. A preferred application is the flat plugs or fast-on terminals used for plug-in connections in relays and the like, but the invention can equally be applied to flat connector elements which are intended for other types of contacting, such as soldering and the like, for which purpose they can, for example, be cut into any shape at the ends.

According to the invention, the abovementioned aim is achieved by means of the following method steps:

a) Before the flat plug is inserted into the base there is stamped from at least one of the two flat sides of said flat plug at least one rib that is elongated in the direction of insertion and is located at least partly on the other side of the perforation after being inserted, and b) starting from its outer end, the part of the rib projecting from the perforation is peeled in the direction towards the base of the flat plug body and deformed against the second surface of the base floor.

Thus, in the invention, a rib previously stamped from the sheet metal material is deformed opposite to the direction of insertion in a combined peeling and compressing operation and is clamped against the second surface of the base floor, that is to say against the underside of the base. Owing to the peeling operation, by contrast with previous processes, compression or deformation in the perforation itself does not occur; on the contrary the part of the rib located outside the perforation is removed in the form of a shaving and compressed and bent towards the underside of the base. This results in the formation of the retaining nose which engages beyond the edge of the perforation and forms a secure positive lock with the underside of the base.

A particularly advantageous embodiment of the method provides that the rib is provided at its outer end with a projection with respect to its remaining part, in particular with respect to the part located in the region of the edge of the base. The rib thus receives, for example, a stepped course having a stamped nose or a swelling at the outer end. This then results in a particularly favorable peeling with the peeled material peeling off outwards, since the peeling tool acts on a large surface area with the projecting tab, while the rib tapering towards the base can easily be peeled without strong compressive deformation having an effect in the region of the base perforation, which could lead to the abovementioned deformations. In the case of the projection on the rib, the result in the case of the fully inserted flat plug is necessarily a distance between the rib surface and the corresponding edge of the base perforation, since said base perforation must be kept wide enough at the relevant point for insertion of the projection. Owing to this gap after insertion, no deformations can occur in the perforation itself even when the rib is also compressed into this region. In any case, the edge of the perforation is also not impaired by the deformation of the flat plug.

It is advantageous for practical embodiment to stamp two ribs on the flat plug and to deform them towards the base floor, as a result of which there is a distribution of the retaining forces. It is also possible to stamp ribs on the flat plug towards both flat sides and peel them in order to form retaining tabs.

According to the invention, a base obtained according to the invention and having one or more flat plugs is characterised in that at least one retaining tab that is stamped out of a flat side of the flat plug and is bent opposite to the direction of insertion rests on the second surface of the base floor. In this arrangement, it is expedient that the perforation in the base corresponds in each case to the cross section of the flat plug inserted through it and has in each case in its side walls guide channels for the stamped ribs. In order to seal said guide channels after the insertion of the flat plug, additional sealing tabs that seal the entire cross section of the guide channels are preferably stamped on the said flat plug.

BRIEF DESCRIPTION OF THE DRAWINGS

The invention is explained below in more detail using an exemplary embodiment and with reference to the drawing, wherein.

DETAILED DESCRIPTION OF THE PREFERRED EMBODIMENTS

Figure 1:
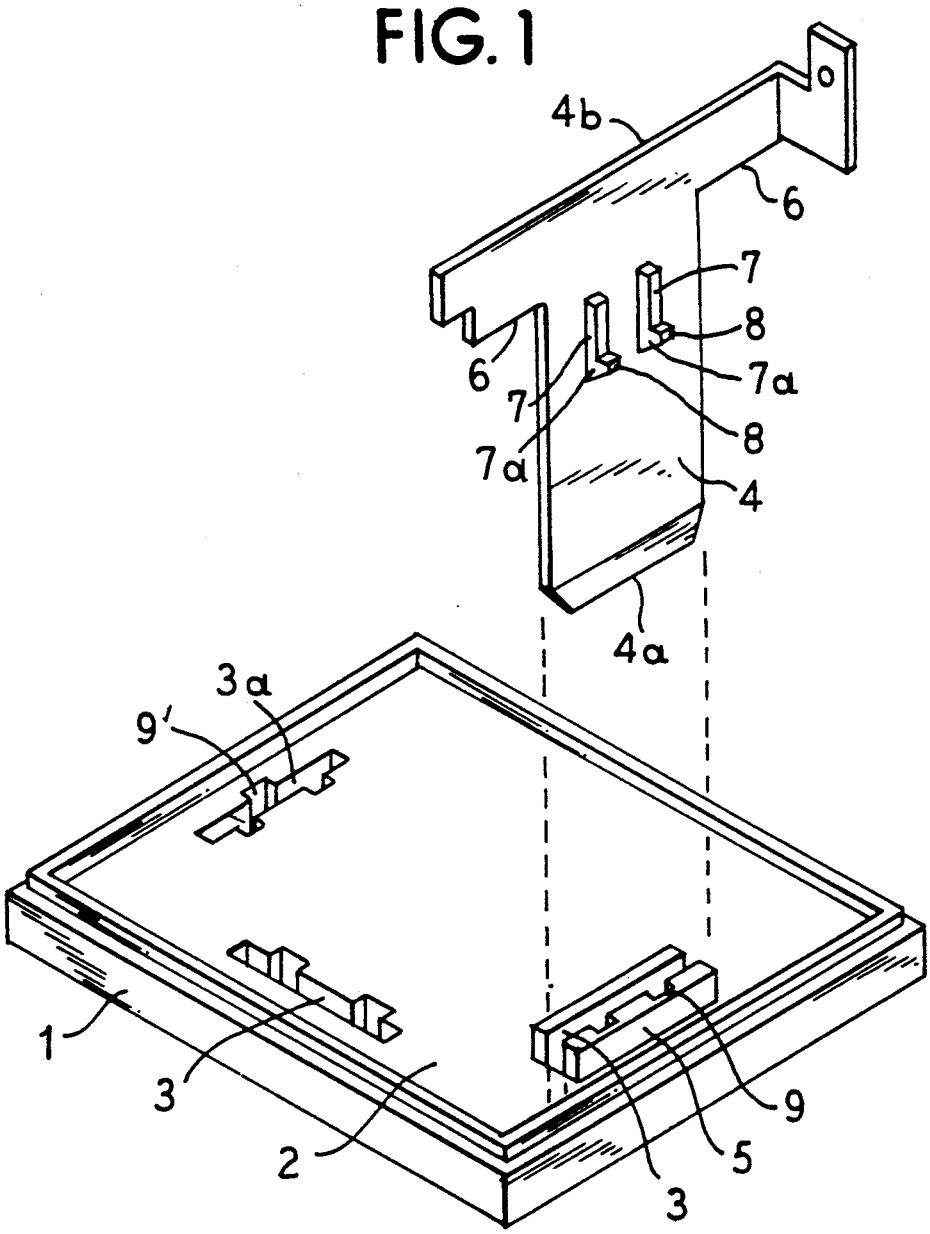
FIG. 1 shows a diagrammatically represented relay base with the flat plug to be inserted, in a perspective representation.

FIG. 1 shows a diagrammatically represented relay base 1 whose base floor 2 has a plurality of perforations 3 for accommodating flat plugs 4 (only one being shown). As shown in an example, additional support ribs 5 can be integrally formed to the side of the perforations, in order to increase the insertion length of the tab 4 and thus to enhance the stability. The tab 4 can be arbitrarily cut and bent on the top side; it serves, for example, for welding on contact elements or wires for conducting contact current or coil current. In any case, said tab 4 has one or two shoulders 6 with which it is supported after insertion into the base 1 on the first side, that is to say the top side, of the base floor 2. Moreover, in the present case, the flat plug has 2 ribs 7 stamped out towards a flat side and extending in the direction of insertion. At their distal ends **7*a*, that is to say at the ends directed towards the free flat plug end 4*a*, they have a stepped raised tab 8. Guide channels 9, whose depth corresponds to the height of the tabs 8, are formed in each case in the side walls of the perforations 3 for the purpose of inserting the ribs 7. Consequently, during assembly, the flat plug 4 can be inserted with its end 4*a* into an associated perforation 3 until the shoulders 6 stand on the base floor 2 and the tabs 8 as well as a part of the ribs 7** project on the underside of the base.

Figure 2:
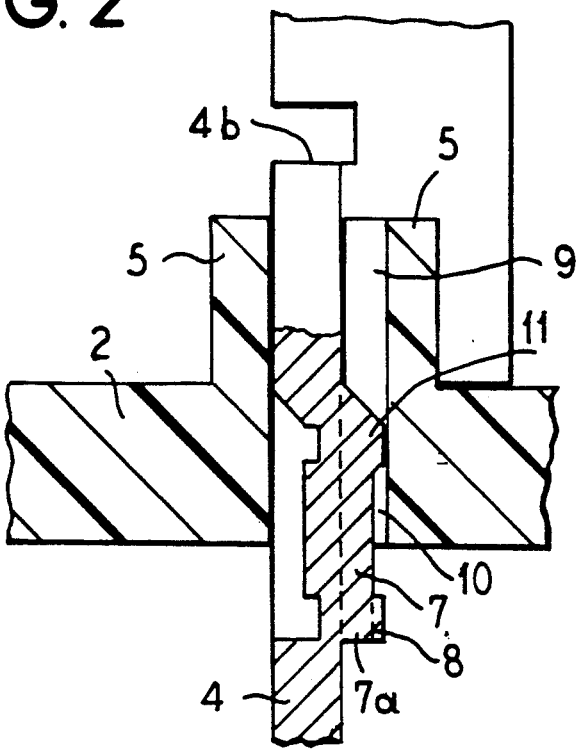
FIGS. 2 and 3 show a detailed view of the flat plug inserted in the base, in section and in plan view.
Figure 3:
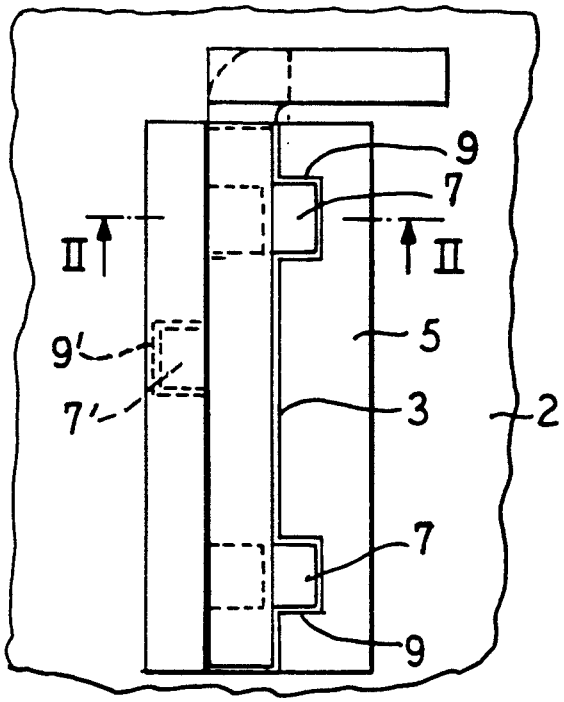

FIGS. 2 and 3 show the state after the insertion assembly of the flat plug 4 in the base floor 2. As may be seen in the sectional representation of FIG. 2, the rib 7 means that the material of the flat plug 4 is stamped outwards approximately over half the thickness. A height of the rib of roughly approximately half the material thickness has proved to be expedient for flat plugs of conventional dimensions, that is to say with a thickness of approximately 0.8 to 1.2 mm, the tab being additionally stamped out accordingly. However, different relationships are also conceivable, in particular in the case of other dimensions of the flat plug material. Since the guide channel 9 for insertion of the tab 8 must be correspondingly deep, an air gap 10 is left between the remaining rib 7 and the wall of the channel 9. For the purpose of sealing the air gap, a sealing tab 11 whose height corresponds to that of the tab 8 is integrally formed at the rear end **7*b* of the rib, so that the cross section of the guide channel 9** is filled up.

FIG. 3 shows a plan view of the inserted flat plug 4. The guide channels 9 of the perforation 3 are visible, as is the flat plug 4 with the ribs 7 stamped out towards one side. Moreover, as is indicated by dashes in FIG. 3 it would also be possible for a rib 7' to be stamped out towards the other side and inserted into a guide channel 9'.

Figure 4:
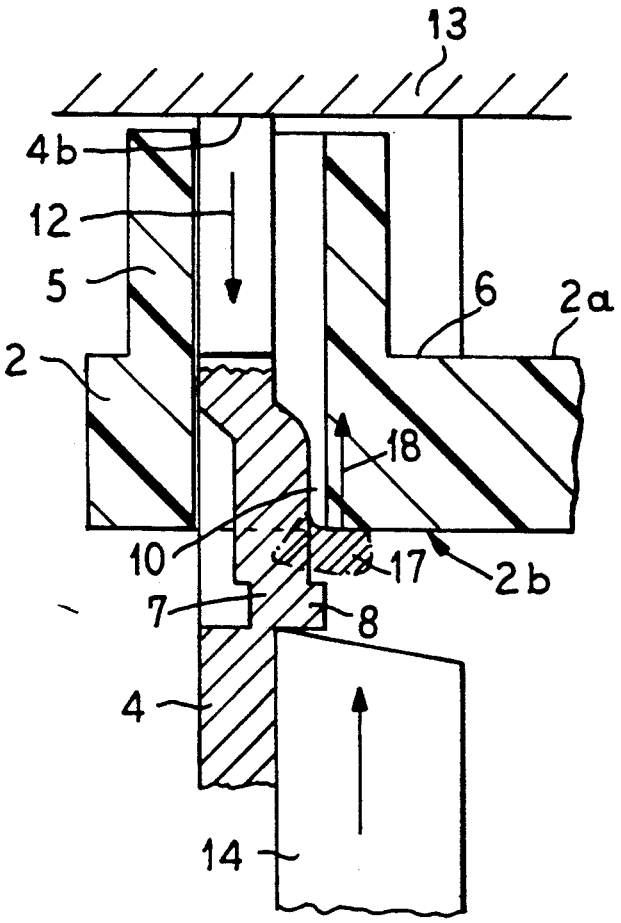
FIG. 4 shows a representation of the deformation operation for fixing the flat plug.

The fixing of the flat plug is shown in FIG. 4. The flat plug 4 is seated with a shoulder 6 on the top side **2*a* of the base floor 2, after it has been inserted into the base in the direction of the arrow 12. The flat plug is supported at its upper edge 4*b* by an abutment 13** against being pressed back during deformation.

With the aid of a notch punch 14 that acts on the tab 8, together with the adjoining part of the rib 7 of the flat plug 4, said tab 8 is peeled, compressed and bent outwards. The material reforming produces a retaining tab 17 which bears against the underside **2*b* of the base floor 2, its direction of action being indicated by the arrow 18. Owing to the air gap 10, virtually no deformation and no lateral pressure are produced in the perforation, whereas the flat plug, however, is fixed to the base in a positively locking fashion by the retaining tab 17**.

Although other modifications and changes may be suggested by those skilled in the art, it is the intention of the inventors to embody within the patent arranged hereon all changes and modifications as reasonably and properly come within the scope of their contribution to the art.

I claim:

1. A method for fastening a flat plug in a base, formed of insulating material, of an electrical component, said flat plug being inserted through a perforation in a flat base floor of said base until said flat plug is supported by at least one integrally formed shoulder on a first surface of said base floor and is then clamped on an opposite second surface of said base floor by at least one projection formed out of said flat plug, the method comprising the following steps:

a) before said flat plug is inserted into said base, stamping from at least one of two flat sides of said flat plug at least one rib that extends out of the plane of the flat plug, is elongated in a direction of insertion, and is located at least partly extending through said second opposite surface after being inserted through said perforation, and b) starting from an outer end of said at least one rib, peeling a part of said at least one rib projecting from said perforation in a direction towards the base and permanently deforming said peeled part against said opposite second surface of said base floor.

2. The method as claimed in claim 1, further comprising the step of: providing a projection at an outer end of said at least one rib, said projection projecting outwardly relative to a portion of said rib located in a region of the base.

3. The method as claimed in claim 2, further comprising the step of: stamping the rib in a stepped fashion to form said projection at said outer end.

4. The method as claimed in claim 2, wherein a reduced portion of said peeled part of the rib reaches at least up to an edge of the perforation on the second surface of the base floor.

5. The method as claimed in claim 1, wherein said step of stamping stamps ribs on the flat plug on both flat sides; and wherein said step of peeling peels said ribs on both sides of the flat plug in the direction towards the base floor after insertion.

6. A base for an electrical component, comprising:

a base floor having first and second surfaces opposite one another and defining a perforation through said base floor at said first and second surfaces;

at least one flat plug extending through said perforation in an insertion direction, said at least one flat plug having at least one shoulder supported on said first surface;

at least one retaining tab having a rib portion extending from a plane of flat side of said at least one flat plug, said at least one retaining tab having a second portion bent opposite to the direction of insertion and resting on the second surface of the base floor to fix said flat plug in said perforation.

7. The base as claimed in claim 6, wherein said perforation in said base floor corresponds in each case to a cross-section of said flat plug and has in each case in side walls of said perforation guide channels for said rib portion of said at least one retaining tab.

8. The base as claimed in claim 6, wherein said flat plug has on each flat side at least one of said retaining tabs, and wherein said base floor defines corresponding guide channels in side walls of said perforation for accepting said retaining tabs.

9. The base as claimed in claim 7, further comprising:

sealing tabs for sealing substantially all of a cross-section of the guide channels being stamped on the flat plug in a region of the base floor.

* * * * *